US011059285B2

(12) United States Patent
Ito

(10) Patent No.: US 11,059,285 B2
(45) Date of Patent: Jul. 13, 2021

(54) LIQUID DISCHARGE HEAD AND PRINTER

(71) Applicant: TOSHIBA TEC KABUSHIKI KAISHA, Tokyo (JP)

(72) Inventor: Shota Ito, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/577,751

(22) Filed: Sep. 20, 2019

(65) Prior Publication Data

US 2020/0101721 A1 Apr. 2, 2020

(30) Foreign Application Priority Data

Oct. 2, 2018 (JP) ..... JP2018-187394

(51) Int. Cl.
*B41J 2/045* (2006.01)

(52) U.S. Cl.
CPC ..... *B41J 2/04516* (2013.01); *B41J 2/04541* (2013.01); *B41J 2/04581* (2013.01); *B41J 2/04588* (2013.01)

(58) Field of Classification Search
CPC ..... B41J 2/04516; B41J 2/04541; B41J 2/04581; B41J 2/04588
See application file for complete search history.

(56) References Cited

U.S. PATENT DOCUMENTS

| | | | | |
|---|---|---|---|---|
| 5,754,204 | A * | 5/1998 | Kitahara | B41J 2/04581 347/70 |
| 2013/0215172 | A1* | 8/2013 | Kaneko | B41J 2/04596 347/10 |
| 2015/0266291 | A1* | 9/2015 | Hasegawa | B41J 2/04581 347/9 |
| 2017/0165964 | A1 | 6/2017 | Misawa et al. | |
| 2018/0370247 | A1* | 12/2018 | Kuki | H04N 1/4057 |

* cited by examiner

*Primary Examiner* — Jason S Uhlenhake
(74) *Attorney, Agent, or Firm* — Kim & Stewart LLP

(57) ABSTRACT

A liquid discharge head includes an actuator and a drive circuit. The actuator is configured to expand and contract a pressure chamber corresponding thereto. The drive circuit is configured to, during a dot formation cycle apply a first discharge pulse to the actuator to cause a first droplet to be discharged from the pressure chamber, and after a predetermined rest period, during which no discharge pulse is applied to the actuator, has elapsed from application of the first discharge pulse, apply a second discharge pulse to the actuator to cause a second droplet to be discharged from the pressure chamber.

16 Claims, 11 Drawing Sheets

| REST PERIOD (AL) | MAIN DROPLET (m/s) | SATELLITE (m/s) | MAIN DROPLET-SATELLITE (μm) |
|---|---|---|---|
| 0.1 | 6.0 | 4.8 | 1.16 |
| 0.3 | 6.0 | 4.9 | 1.12 |
| 0.6 | 6.0 | 5.1 | 0.90 |
| 0.8 | 6.0 | 5.3 | 0.72 |
| 1 | 6.0 | 5.5 | 0.54 |
| 1.2 | 6.0 | 5.5 | 0.50 |

501

LIQUID DISCHARGE HEAD AND PRINTER

CROSS-REFERENCE TO RELATED APPLICATION

This application is based upon and claims the benefit of priority from Japanese Patent Application No. 2018-187394, filed on Oct. 2, 2018, the entire contents of which are incorporated herein by reference.

FIELD

Embodiments described herein relate generally to a liquid discharge head and a printer.

BACKGROUND

Some liquid discharge heads such as ink jet heads discharge a plurality of ink droplets to form one dot on a medium. In such ink jet heads, tailing from the main droplet to a meniscus may occur after the ink droplet is discharged. Satellites or mist of the liquid may be generated due to the tailing.

DETAILED DESCRIPTION

Embodiments provide a liquid discharge head capable of reducing satellites or mist.

In general, according to an embodiment, a liquid discharge head includes an actuator and a drive circuit. The actuator is configured to expand and contract a pressure chamber corresponding thereto. The drive circuit is configured to, during a dot formation cycle apply a first discharge pulse to the actuator to cause a first droplet to be discharged from the pressure chamber, and after a predetermined rest period, during which no discharge pulse is applied to the actuator, has elapsed from application of the first discharge pulse, apply a second discharge pulse to the actuator to cause a second droplet to be discharged from the pressure chamber.

Hereinafter, a printer according to an embodiment will be described using the drawings.

A printer according to an embodiment forms an image on a medium such as paper using an ink jet head. The printer discharges ink in a pressure chamber provided in an ink jet head onto a medium to form an image on the medium. The printer is, for example, an office printer, a bar code printer, a POS printer, an industrial printer, a 3D printer, or the like. The medium on which the printer forms an image is not limited to a specific configuration. The ink jet head provided in the printer according to the embodiment is an example of a liquid discharge head, and the ink is an example of liquid.

Figure 1:
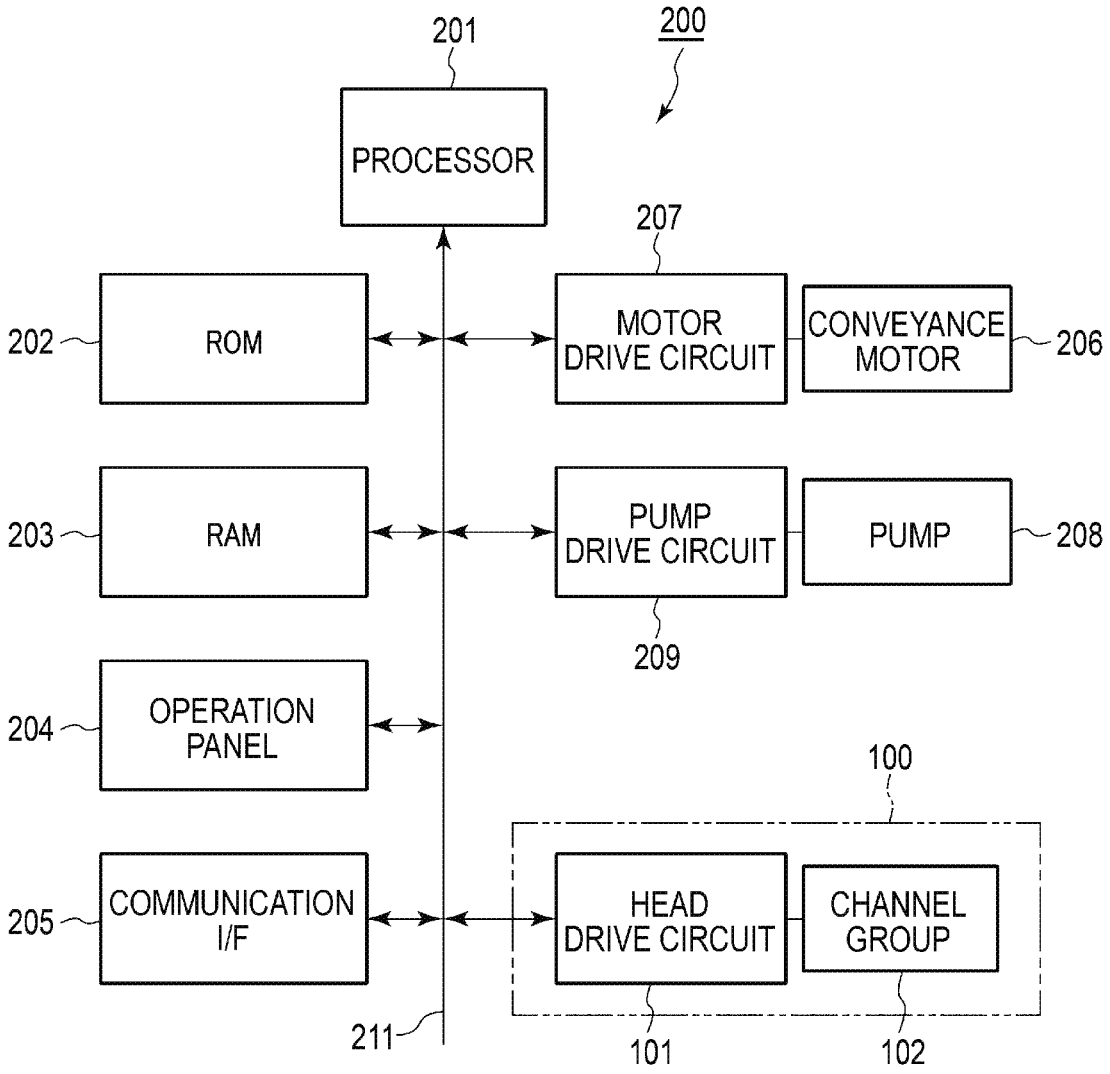
FIG. 1 is a block diagram illustrating an example of a configuration of a printer according to an embodiment.

FIG. 1 is a block diagram illustrating an example of a configuration of a printer 200.

As illustrated in FIG. 1, the printer 200 includes a processor 201, a ROM 202, a RAM 203, an operation panel 204, a communication interface 205, a conveyance motor 206, a motor drive circuit 207, a pump 208, a pump drive circuit 209, an ink jet head 100, and the like. The ink jet head 100 includes a head drive circuit 101, a channel group 102, and the like. The printer 200 also includes a bus line 211 such as an address bus or a data bus. The processor 201 is connected to the ROM 202, the RAM 203, the operation panel 204, the communication interface 205, the motor drive circuit 207, the pump drive circuit 209, and the head drive circuit 101 directly or through an input/output circuit via the bus line 211. In addition, the motor drive circuit 207 is connected to the conveyance motor 206. The pump drive circuit 209 is also connected to the pump 208.

The printer 200 may further include other elements as needed in addition to the above elements illustrated in FIG. 1, or a specific element may be excluded from the printer 200.

The processor 201 has a function of controlling the overall operation of the printer 200. The processor 201 may include an internal cache, various interfaces, and the like. The processor 201 implements various processes by executing a program stored in advance by the internal cache or the ROM 202. The processor 201 implements various functions as the printer 200 according to an operating system, an application program, and the like.

Some of the various functions implemented by executing a program by the processor 201 may be implemented by a hardware circuit. In this case, the processor 201 controls the function performed by the hardware circuit.

The ROM 202 is a non-volatile memory in which a control program and control data are stored in advance. The control program and control data stored in the ROM 202 are incorporated in advance according to the specifications of the printer 200. For example, the ROM 202 stores an operating system, an application program, and the like.

The RAM 203 is a volatile memory. The RAM 203 temporarily stores data and the like being processed by the processor 201. The RAM 203 stores various application programs and the like based on an instruction from the processor 201. In addition, the RAM 203 may store data required for executing the application program, an execution result of the application program, and the like. Further, the RAM 203 may function as an image memory in which print data is expanded.

The operation panel 204 is an interface that receives an input from an operator and displays various types of information to the operator. The operation panel 204 includes an operation unit that receives an input, and a display unit that displays information.

The operation panel 204 transmits a signal indicating an operation received from the operator to the processor 201 as the operation of the operation unit. For example, the operation unit includes function keys such as a power supply key, a paper feed key, and an error release key.

The operation panel 204 displays various types of information based on the control of the processor 201 as the operation of the display unit. For example, the operation panel 204 displays the status of the printer 200 and the like. For example, the display unit is configured of a liquid crystal monitor.

The operation unit may be configured as a touch panel. In this case, the display unit may be integrally formed with the touch panel as the operation unit.

The communication interface 205 is an interface for transmitting and receiving data to and from an external device via a network such as a local area network (LAN). For example, the communication interface 205 is an interface that supports LAN connection. For example, the communication interface 205 receives print data from the client terminal via the network. For example, when an error occurs in the printer 200, the communication interface 205 transmits a signal notifying the error to a client terminal.

The motor drive circuit 207 controls driving of the conveyance motor 206 according to the signal from the processor 201. For example, the motor drive circuit 207 transmits a power or control signal to the conveyance motor 206.

The conveyance motor 206 functions as a drive source of a conveyance mechanism that conveys a medium such as paper based on the control of the motor drive circuit 207. When the conveyance motor 206 is driven, the conveyance mechanism starts conveyance of the medium. The conveyance mechanism conveys the medium to the printing position by the ink jet head 100. The conveyance mechanism discharges a printed medium to the outside of the printer 200 from a discharge port (not illustrated).

The motor drive circuit 207 and the conveyance motor 206 make up a conveyance unit that conveys the medium.

The pump drive circuit 209 controls the drive of the pump 208. When the pump 208 is driven, ink is supplied from an ink tank to the ink jet head 100.

The ink jet head 100 discharges ink droplets to a medium based on print data. The ink jet head 100 includes a head drive circuit 101, a channel group 102, and the like.

Hereinafter, the ink jet head 100 according to the embodiment will be described using the drawings. In the embodiment, the ink jet head 100 (refer to FIG. 2) of a share mode type is described. The inkjet head 100 will be described as an ink jet head that discharges ink onto paper. The medium on which the ink jet head 100 discharges ink is not limited to a specific configuration.

Figure 2:
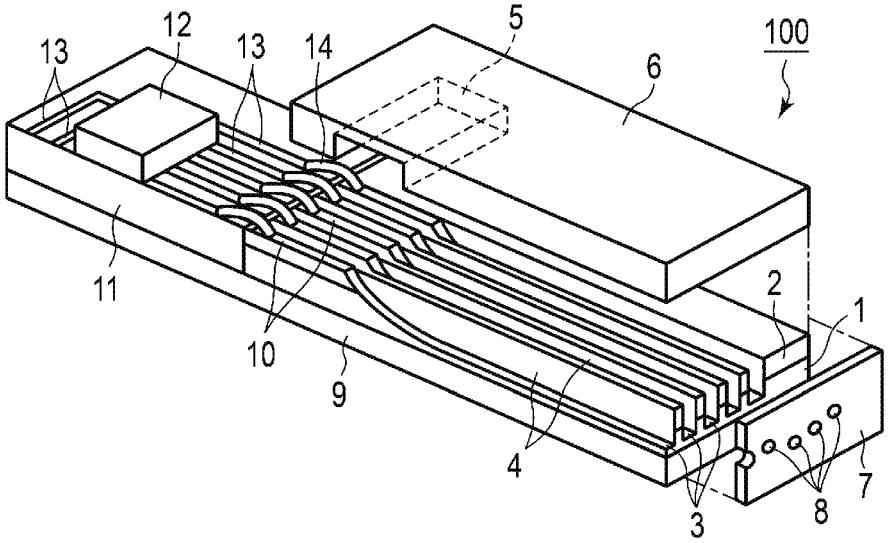
FIG. 2 illustrates a perspective view of an example of an ink jet head according to the embodiment.
Figure 3:
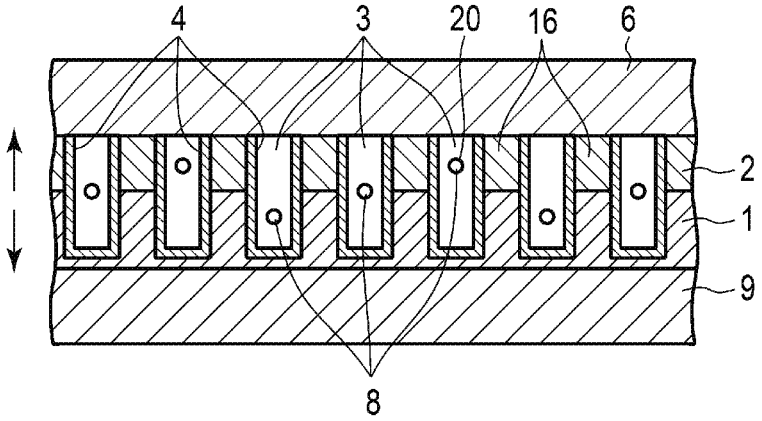
FIG. 3 illustrates a cross-sectional view of the ink jet head.
Figure 4:
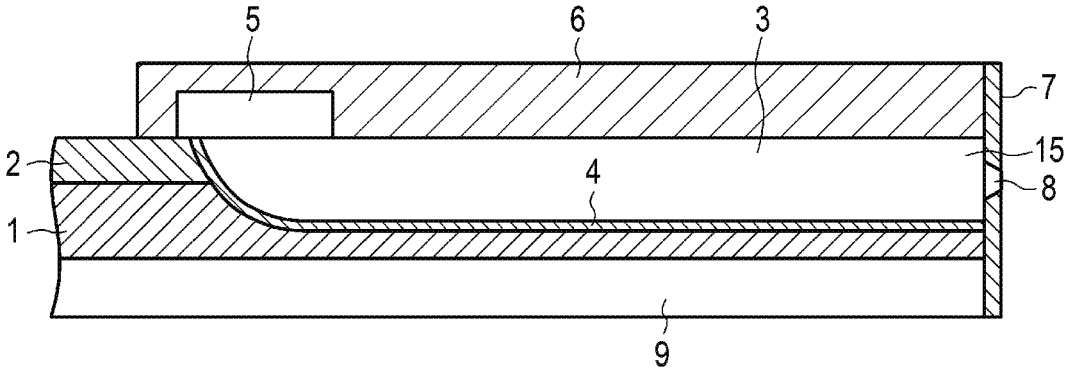
FIG. 4 illustrates a longitudinal cross-sectional view of the ink jet head.

Next, the example of the configuration of the ink jet head 100 will be described using FIGS. 2 to 4. FIG. 2 illustrates a perspective view of a part of the ink jet head 100 in an exploded manner. FIG. 3 illustrates a cross-sectional view of the ink jet head 100. FIG. 4 illustrates a longitudinal cross-sectional view of the inkjet head 100.

The ink jet head 100 has a base substrate 9. In the ink jet head 100, a first piezoelectric member 1 is joined with an upper surface of the base substrate 9, and a second piezoelectric member 2 is joined on the first piezoelectric member 1. The joined first piezoelectric member 1 and second piezoelectric member 2 are polarized in mutually opposite directions along the thickness direction, as illustrated by the arrows in FIG. 3.

The base substrate 9 is formed using a material having a small dielectric constant and a small difference in thermal expansion coefficient between the first piezoelectric member 1 and the second piezoelectric member 2. As the material of the base substrate 9, for example, alumina ($Al_2O_3$), silicon nitride ($Si_3N_4$), silicon carbide (SiC), aluminum nitride (AlN), lead zirconate titanate (PZT) or the like may be used. As the materials of the first piezoelectric member 1 and the second piezoelectric member 2, lead zirconate titanate (PZT), lithium niobate ($LiNbO_3$), lithium tantalate ($LiTaO_3$) or the like may be used.

The ink jet head 100 includes a number of long grooves 3 from a leading end side to a rear end side of the joined structure of the first piezoelectric member 1 and second piezoelectric member 2. Grooves 3 are spaced at constant intervals and are arranged in parallel. Each of the grooves 3 is open at the leading end and inclined upward at the rear end.

The ink jet head 100 includes electrodes 4 on the side walls and the bottom of each groove 3. The electrode 4 has a two-layer structure of nickel (Ni) and gold (Au). The electrodes 4 are uniformly deposited in the respective grooves 3 by plating, for example. The method of forming the electrode 4 is not limited to the plating method. Additionally, a sputtering method, a vapor deposition method or the like can also be used.

The ink jet head 100 includes a lead-out electrode 10 from the rear end of each groove 3 toward the rear upper surface of the second piezoelectric member 2. The lead-out electrode 10 extends from the electrode 4.

The ink jet head 100 includes a top plate 6 and an orifice plate 7. The top plate 6 closes the upper portion of each groove 3. The orifice plate 7 closes the leading end of each groove 3. In the ink jet head 100, a plurality of pressure chambers 15 are formed by the grooves 3, each of which is surrounded by the top plate 6 and the orifice plate 7. The pressure chamber 15 is filled with the ink supplied from the ink tank. The pressure chambers 15 have, for example, a shape with a depth of 300 μm and a width of 80 μm, and are arranged in parallel at a pitch of 169 μm. Such pressure chamber 15 is also referred to as an ink chamber.

The top plate 6 includes a common ink chamber 5 at the rear side inside the top plate. The orifice plate 7 includes nozzles 8 at positions facing the grooves 3. The nozzle 8 communicates with the facing groove 3, that is, the pressure chamber 15. The nozzle 8 has a shape tapered from the pressure chamber 15 side to the opposite ink discharge side. The nozzles 8 corresponding to three adjacent pressure chambers 15 is set as one set, and are formed to be shifted at constant intervals in the height direction of the grooves 3 (in the vertical direction in the drawing of FIG. 3).

When the pressure chamber 15 is filled with ink, a meniscus 20 of the ink is formed on the nozzle 8. The meniscus 20 is formed along the inner wall of the nozzle 8.

The first piezoelectric member 1 and the second piezoelectric member 2 that form partition walls of the pressure chambers 15 are sandwiched by the electrodes 4 provided in each of the pressure chambers 15 and form an array of actuators 16 for driving the pressure chambers 15.

In the ink jet head 100, a printed circuit board 11 on which a conductive pattern 13 is formed is joined to the upper surface on the rear side of the base substrate 9. In the ink jet head 100, a drive IC 12 in which a head driving circuit 101 described below is mounted on the printed circuit board 11 is mounted. The drive IC 12 is connected to the conductive pattern 13. The conductive pattern 13 is coupled to each lead-out electrode 10 with a conducting wire 14 by wire bonding.

A set of the pressure chamber 15, the electrode 4 and the nozzle 8 of the inkjet head 100 is referred to as a channel. That is, the ink jet head 100 has channels ch. 1, ch. 2, . . . , ch. N same as the number N of the grooves 3.

Next, the head drive circuit 101 will be described.

Figure 5:
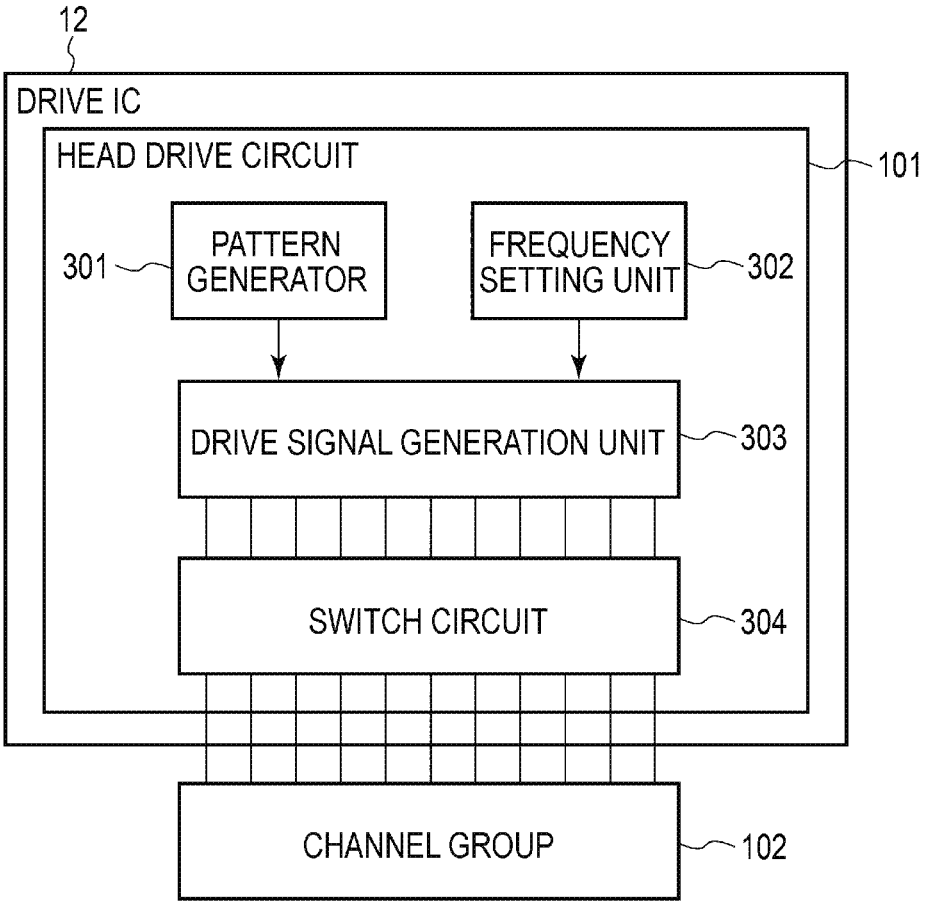
FIG. 5 is a block diagram illustrating an example of a configuration of a head drive circuit according to the embodiment.

FIG. 5 is a block diagram for explaining an example of the configuration of the head drive circuit 101. As described above, the head drive circuit 101 is arranged in the drive IC 12.

The head drive circuit 101 drives the channel group 102 of the ink jet head 100 based on print data.

The channel group 102 includes a plurality of channels (ch. 1, ch. 2, . . . , ch. N) including the pressure chamber 15, the electrode 4, the nozzle 8 and the like. That is, based on the control signal from the head drive circuit 101, the channel group 102 discharge ink by the operation of each pressure chamber 15 which is expanded or contracted by the corresponding actuator 16.

As illustrated in FIG. 5, the head drive circuit 101 includes a pattern generator 301, a frequency setting unit 302, a drive signal generation unit 303, a switch circuit 304, and the like.

The pattern generator 301 generates various waveform patterns using a waveform pattern of an expansion pulse for expanding the volume of the pressure chamber 15, a release period for releasing the volume of the pressure chamber 15, and a waveform pattern of a contraction pulse for contracting the volume of the pressure chamber 15.

The pattern generator 301 generates a waveform pattern of a discharge pulse for discharging one ink droplet. A discharge pulse period is a time period for discharging one ink droplet, that is, a so-called 1 drop cycle.

The discharge pulse will be described later.

The frequency setting unit 302 sets the driving frequency of the ink jet head 100. The drive frequency is a frequency of drive pulses generated by the drive signal generation unit 303. The head drive circuit 101 is operated according to the drive pulses.

The drive signal generation unit 303 generates a pulse for each channel based on the waveform pattern generated by the pattern generator 301 and the drive frequency set by the frequency setting unit 302 according to the print data input from the bus line. The pulse for each channel is output from the drive signal generation unit 303 to the switch circuit 304.

The switch circuit 304 switches the voltage to be applied to the electrode 4 of each channel in accordance with the pulse for each channel output from the drive signal generation unit 303. That is, the switch circuit 304 applies a voltage to the actuator 16 of each channel based on the conduction time of the expansion pulse set by the pattern generator 301 or the like.

The switching circuit 304 expands or contracts the volume of the pressure chamber 15 of each channel by switching the voltage, and discharges ink droplets by the number of gradations from the nozzles 8 of each channel.

Next, an operation example of the ink jet head 100 configured as described above will be described with reference to FIGS. 6 to 8.

Figure 6:
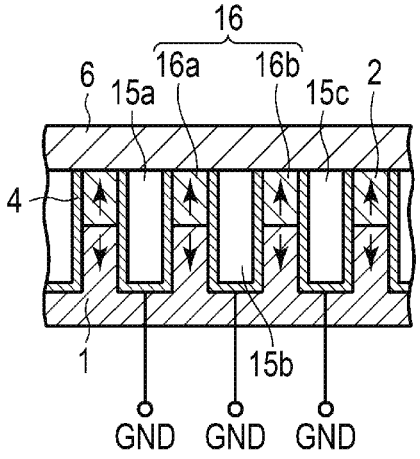
FIGS. 6-8 illustrate an operation example of the ink jet head.

FIG. 6 illustrates a state of the pressure chamber 15*b* in a release period and/or in a rest period. This state may be referred to as a default state or a neutral state. As illustrated in FIG. 6, in the head drive circuit 101, all the potentials of the electrodes 4 respectively arranged on each of wall surfaces of a pressure chamber 15*b* and pressure chambers 15*a* and 15*c* adjacent to the pressure chamber 15*b* are set to the ground potential GND. In this state, a partition wall 16*a* sandwiched between the pressure chamber 15*a* and the pressure chamber 15*b* and a partition wall 16*b* sandwiched between the pressure chamber 15*b* and the pressure chamber 15*c* do not have distortion.

Figure 7:
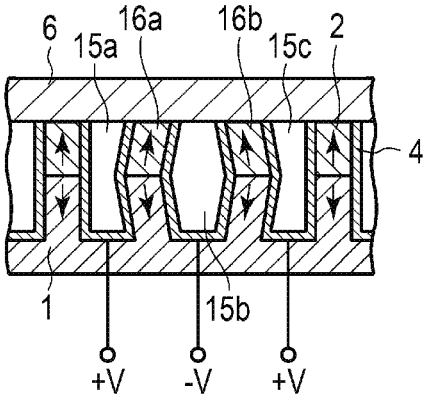

FIG. 7 illustrates an example of a state in which the head drive circuit 101 applies an expansion pulse to the actuator 16 corresponding to the pressure chamber 15*b*. As illustrated in FIG. 7, the head drive circuit 101 applies a negative voltage −V to the electrode 4 of the central pressure chamber 15*b*, and applies a positive voltage +V to the electrodes 4 of the pressure chambers 15*a* and 15*c* on both sides of the pressure chamber 15*b*. In this state, an electric field of 2 V is applied to each of the partition walls 16*a* and 16*b* in a direction orthogonal to the polarization direction of the first piezoelectric member 1 and the second piezoelectric member 2. By this action, each of the partition walls 16*a* and 16*b* is respectively deformed outward to expand the volume of the pressure chamber 15*b*.

Figure 8:
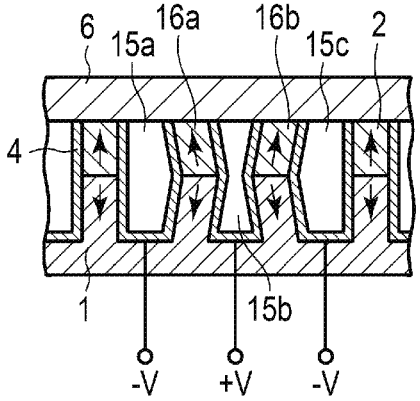

FIG. 8 illustrates an example in which the head drive circuit 101 applies a contraction pulse to the actuator 16 corresponding to the pressure chamber 15*b*. As illustrated in FIG. 8, the head drive circuit 101 applies a positive voltage +V to the electrode 4 of the central pressure chamber 15*b*, and applies a negative voltage −V to the electrodes 4 of the pressure chambers 15*a* and 15*c* on both sides. In this state, an electric field having a voltage of 2 V is applied to each of the partition walls 16*a* and 16*b* in a direction opposite to the direction in FIG. 7. By this action, each of the partition walls 16*a* and 16*b* is respectively deformed inward to contract the volume of the pressure chamber 15*b*.

When the volume of the pressure chamber 15*b* is expanded or contracted, pressure vibration occurs in the pressure chamber 15*b*. Due to this pressure vibration, the pressure in the pressure chamber 15*b* is increased, and an ink droplet is discharged from the nozzle 8 communicating with the pressure chamber 15*b*.

Thus, the partition walls 16*a* and 16*b* separating the respective pressure chambers 15*a*, 15*b* and 15*c* form an actuator 16 for applying pressure vibration to the inside of the pressure chamber 15*b* having the partition walls 16*a* and 16*b* as wall surfaces. That is, the pressure chamber 15 is expanded or contracted by the operation of the actuator 16.

In addition, each pressure chamber 15 shares the actuator 16 with the adjacent pressure chamber 15 respectively. For this reason, the head drive circuit 101 cannot drive each pressure chamber 15 simultaneously. The head drive circuit 101 divides each pressure chamber 15 into (n+1) groups at intervals of n (n is an integer of 2 or more) and drives the pressure chambers. In the present embodiment, the head drive circuit 101 is an example of the so-called three-division drive in which every two pressure chambers 15 are divided and driven into three groups. The three-division drive is merely an example and may be four-division drive or five-division drive.

Figure 9:
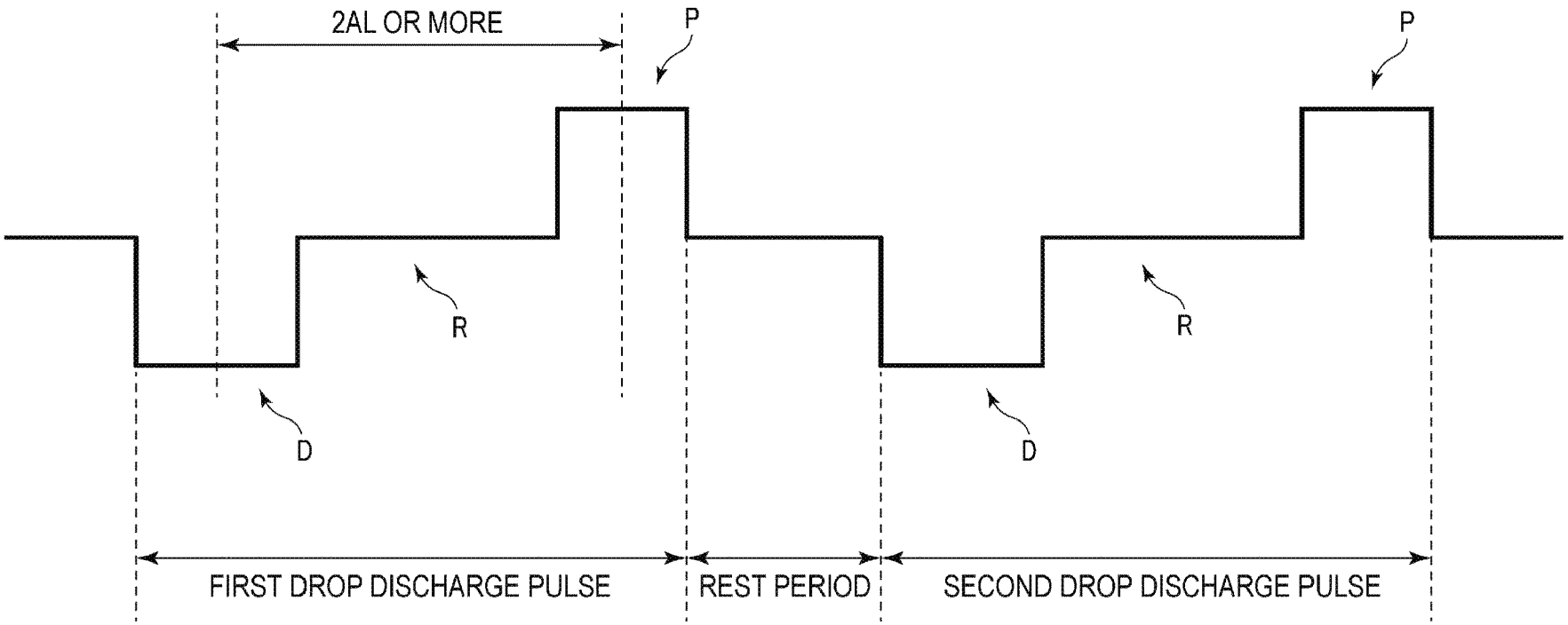
FIG. 9 illustrates an example of a discharge pulse applied to an actuator.

Next, the pulses to be applied to the actuator 16 by the head drive circuit 101 will be described. FIG. 9 illustrates an example of the configuration of pulses applied to the actuator 16 by the head drive circuit 101. Here, it is assumed that the head drive circuit 101 continuously applies a plurality of discharge pulses for discharging ink to form one dot. That is, to form one dot, the ink jet head continuously discharges a plurality of ink droplets based on the discharge pulses, respectively, during a dot formation cycle. The dot formation cycle is repeated multiple times to form a plurality of dots.

As illustrated in FIG. 9, a period during which the discharge pulse for a first droplet is applied includes an expansion period (D), a release period (R), and a contraction period (P).

First, an expansion pulse is applied to the actuator 16 in the expansion period. The expansion pulse expands the volume of the pressure chamber 15 formed by the actuator 16. That is, the expansion pulse brings the pressure chamber 15 into the state illustrated in FIG. 7. In this state, the pressure of the pressure chamber 15 is reduced, and the ink is supplied to the pressure chamber 15 from the common ink chamber 5. The expansion pulse is formed to have a predetermined width. That is, the expansion pulse expands the volume of the pressure chamber 15 for a predetermined length of time. For example, the width of the expansion pulse is about half (AL) of the natural vibration period of the pressure chamber 15.

When the expansion period passes, the pressure chamber 15 is released at the release period. That is, the pressure chamber 15 returns to a default state (the state of FIG. 6).

When the release period passes, the contraction pulse is applied to the actuator 16 during the contraction period. The contraction pulse reduces the volume of the pressure chamber 15 corresponding to the actuator 16. That is, the contraction pulse brings the pressure chamber 15 into the state illustrated in FIG. 8. While the contraction pulse is applied to the actuator 16, the pressure in the pressure chamber 15 rises. As the pressure in the pressure chamber 15 rises, the velocity of the meniscus 20 formed on the nozzle 8 increases and then exceeds the threshold at which the ink droplet is discharged. The ink droplet is discharged from the nozzle 8 of the pressure chamber 15 at the timing when the velocity of the meniscus 20 exceeds a discharge threshold.

In addition, a period between the midpoint of the expansion period and the midpoint of the contraction period is 2 AL or more. That is, the sum of ½ of the expansion period, ½ of the release period, and ½ of the contraction period is 2 AL or more.

After the discharge pulse of the first droplet is applied to the actuator 16, the head drive circuit 101 stands by for a rest period. When the rest period passes, the head drive circuit 101 applies a second discharge pulse to the actuator 16. The discharge pulse for the second droplet is the same as the discharge pulse for the first droplet, and thus the description thereof is omitted.

The head drive circuit 101 applies the discharge pulse for the second droplet while the pressure vibration generated by the discharge pulse of the first droplet is being reduced, but not completely ended. That is, the head drive circuit 101 sets the length of the rest period so that the period during which the pressure vibration is being reduced overlaps with the expansion period of the discharge pulse of the second droplet.

Figure 10:
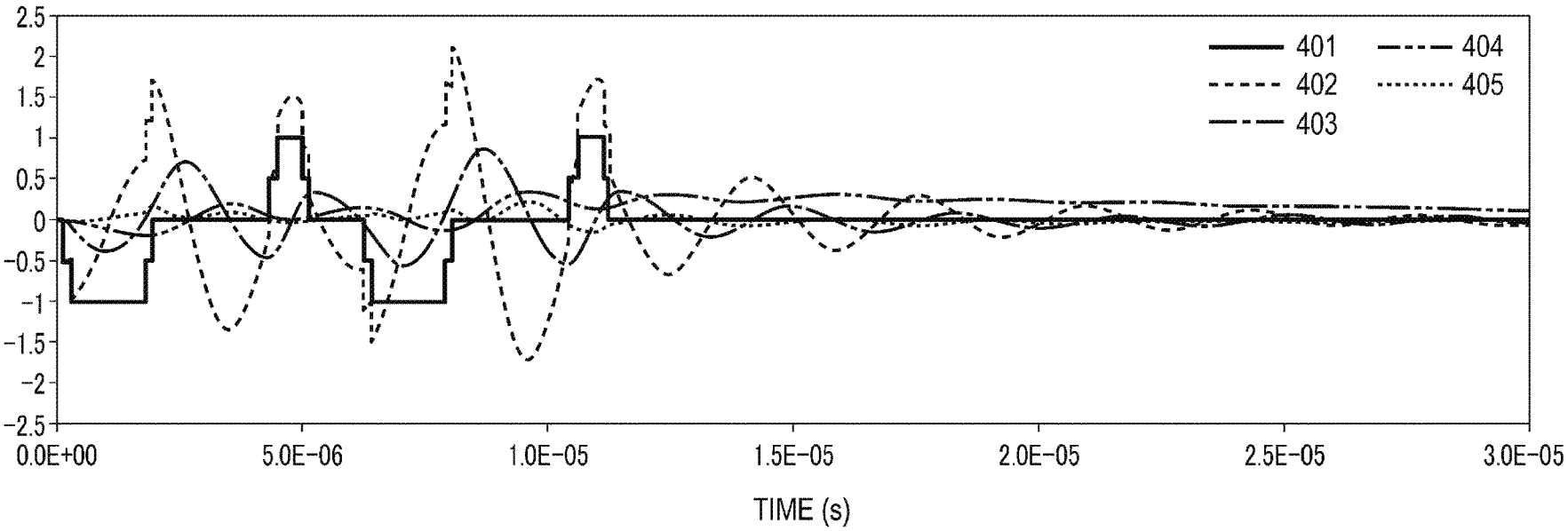
FIGS. 10 and 11 illustrate examples of pressure vibration and the like generated from discharge pulses.

Next, an example of pressure vibration or the like generated in the pressure chamber 15 will be described. FIG. 10 is a graph for explaining an example of pressure vibration or the like generated in the pressure chamber 15.

In FIG. 10, a graph 401 shows the pulse that the head drive circuit 101 applies to an actuator 16 corresponding to the pressure chamber 15. A graph 402 shows the pressure vibration that occurs in the pressure chamber 15. A graph 403 shows the flow velocity of the meniscus 20. A graph 404 shows the position of the meniscus 20 from a predetermined reference position. A graph 405 shows the driving force of the meniscus 20. In addition, also in FIGS. 11 and 15 described below, the same reference symbols are used for description.

In the example illustrated in FIG. 10, the AL is 1.7 μs, the expansion period is 1.7 μs (1 AL), the release period is 2.5 μs (1.5 AL), the contraction period is 0.7 μs (0.4 AL), and a rest period of 1 μs (0.6 AL) is illustrated.

As shown by the graph 402, after the discharge pulse for the first droplet is applied, the pressure vibration generated by the discharge pulse for the first droplet continues. The head drive circuit 101 applies the discharge pulse for the second droplet after the rest period passes. The head drive circuit 101 applies the discharge pulse for the second droplet while the pressure vibration generated by the discharge pulse for the first droplet is being reduced.

When the head drive circuit 101 applies the discharge pulse for the second droplet, the pressure in the pressure chamber 15 is decreased in the expansion period of the discharge pulse for the second droplet. That is, the pressure vibration is amplified by a decrease in pressure due to the pressure vibration generated by the discharge pulse for the first droplet and a decrease in pressure due to the expansion pulse for the discharge pulse for the second droplet.

As shown by the graph 402, the pressure in the expansion period of the second droplet discharge pulse is lower than the pressure in the expansion period of the first droplet discharge pulse. In addition, the pressure vibration is amplified, so that the pressure in the contraction period of the second droplet discharge pulse is higher than the pressure in the contraction period of the first droplet discharge pulse. As a result, the discharge rate of the second droplet is faster than the discharge rate of the first droplet.

Figure 11:
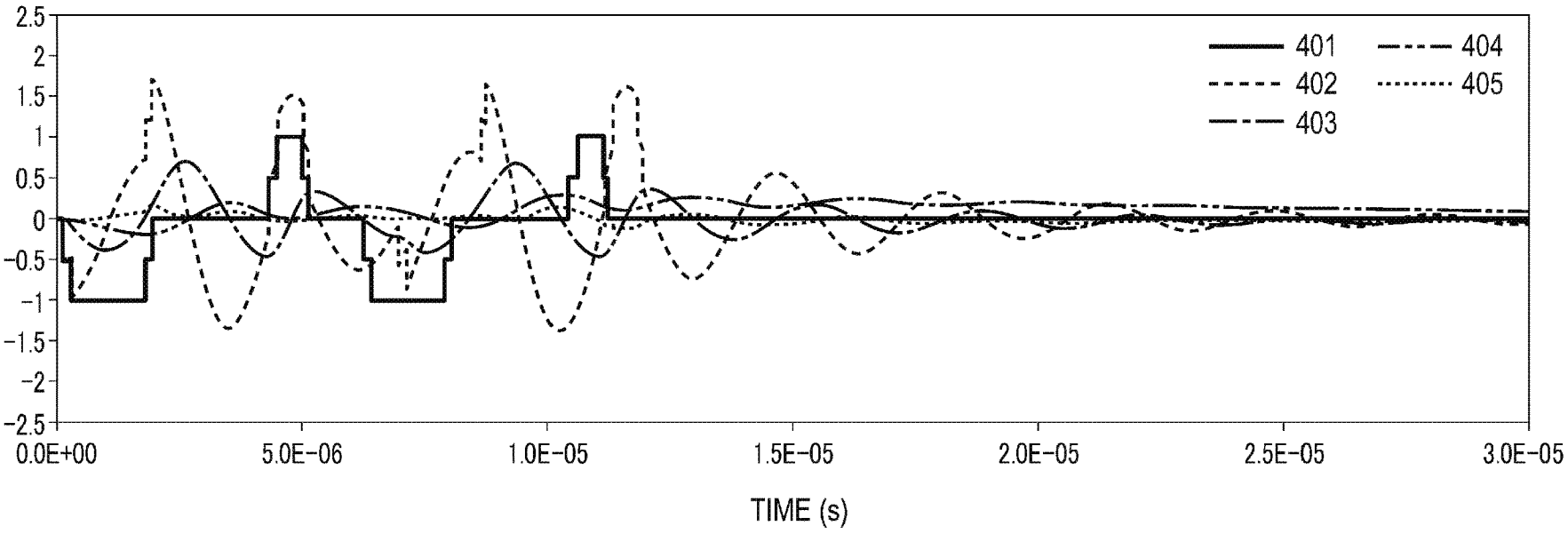

Next, another example of pressure vibration generated in the pressure chamber 15 and the like will be described. FIG. 11 is a graph for explaining another example of pressure vibration generated in the pressure chamber 15 and the like.

In FIG. 11, similarly to FIG. 10, the graph 401 shows pulses applied to the actuator 16 by the head drive circuit 101.

In the example illustrated in FIG. 11, the AL is 1.7 μs, the expansion period is 1.7 μs (1 AL), the release period is 2.5 μs (1.5 AL), the contraction period is 0.7 μs (0.4 AL), and a rest period of 1.7 μs (1 AL) is illustrated.

As shown by the graph 402, similarly to FIG. 10, after the discharge pulse for the first droplet is applied, the pressure vibration generated by the discharge pulse for the first droplet continues. The head drive circuit 101 applies the discharge pulse for the second droplet after the rest period passes.

In the example illustrated in FIG. 11, the head drive circuit 101 applies the discharge pulse for the second droplet while the pressure vibration generated by the discharge pulse for the first droplet rises. Therefore, the pressure vibration generated by the discharge pulse for the first droplet is suppressed by the expansion pulse of the discharge pulse for the second droplet.

As a result, the discharge rate of the second droplet does not increase to a value higher than the discharge rate of the first droplet. That is, when the rest period is 1 AL or more, the discharge rate of the second droplet does not increase to a value higher than the discharge rate of the first droplet. Therefore, it is desirable for the head drive circuit 101 to set the rest period to 1 AL or less (0.5 times or less of the natural vibration period of the pressure in the pressure chamber).

Figure 12:
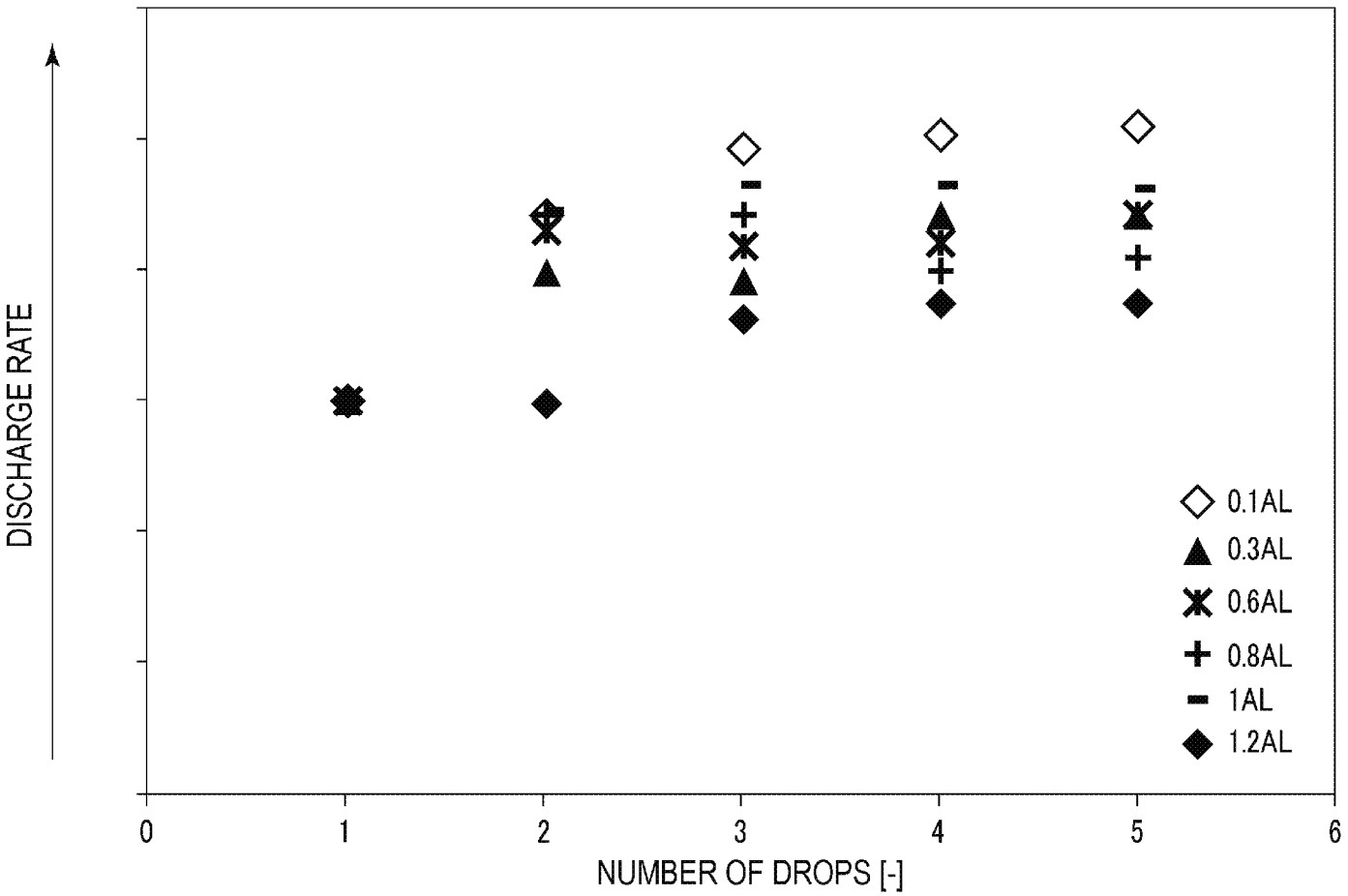
FIG. 12 is a graph showing a relationship between a rest period and a discharge rate.

Next, a relationship between the rest period and the discharge rate will be described. FIG. 12 is a graph for explaining the relationship between the rest period and the discharge rate.

FIG. 12 shows the discharge rate when the rest period is 0.1 AL, 0.3 AL, 0.6 AL, 0.8 AL, 1 AL and 1.2 AL. Also, FIG. 12 shows the discharge rate of the ink up to the sixth droplet.

As shown in FIG. 12, when the rest period is 0.1, the discharge rate of the second droplet of ink is the same as the discharge rate of the first droplet of ink. In addition, when the rest period is 0.3 AL or more (0.15 times or more of the natural vibration period of the pressure of the pressure chamber 15), the discharge rate of the second droplet of ink is higher than the discharge rate of the first droplet of ink.

Figures 13, 14:
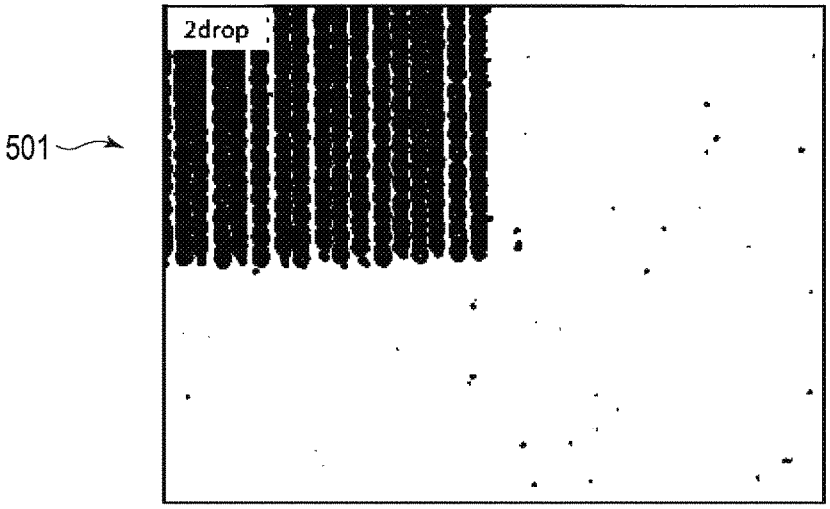
FIG. 13 is a table showing a relationship between the rest period and a distance between a main droplet and a satellite.
FIG. 14 illustrates an example of an image formed based on the discharge pulses.

Next, a relationship between the rest period and the distance between the main droplet and the satellite will be described. FIG. 13 is a table for explaining the relationship between the rest period and the distance between the main droplet and the satellite.

FIG. 13 shows an example in which two ink droplets are discharged. Further, here, the head drive circuit 101 applies a voltage at which the discharge rate of the second droplet is 6 m/s.

As shown in FIG. 13, the distance between the main droplet and the satellite decreases as the rest period increases. That is, the longer the rest period, the more the generation of mist or satellite is suppressed.

Next, an image formed by the ink jet head 100 according to the embodiment will be described. FIG. 14 illustrates an example of an image formed by the ink jet head 100 according to the embodiment. In FIG. 14, the rest period is 0.6 AL. Further, the ink jet head 100 forms an image 501.

As illustrated in FIG. 14, satellites are formed on paper other than the region where the image 501 is formed. Compared to the example of FIG. 16 described below, the formed satellites are suppressed.

Figure 15:
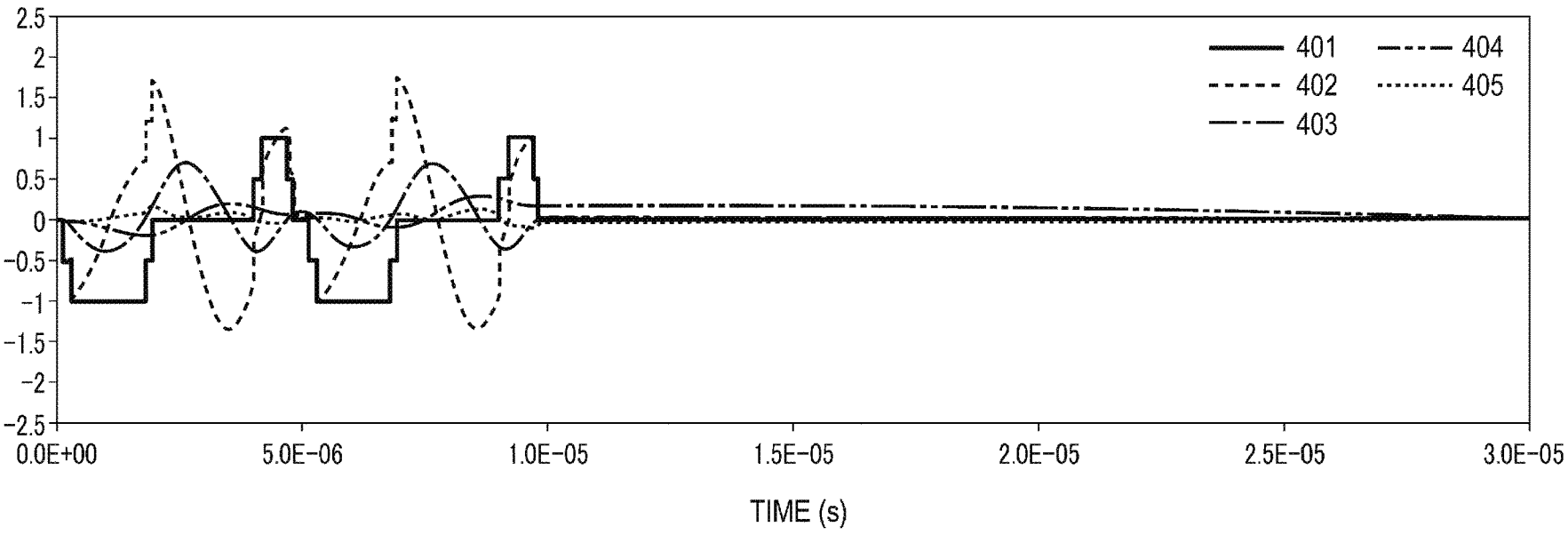
FIG. 15 is a diagram illustrating an example of pressure vibration and the like generated based on discharge pulses of the related art.

Next, a discharge pulse of the related art will be described. FIG. 15 is a graph for explaining an example of pressure vibration or the like generated in the pressure chamber 15 based on discharge pulses of the related art.

In FIG. 15, the graph 401 shows pulses of the related art that the head drive circuit 101 applies to the actuator 16.

In the example illustrated in FIG. 15, the AL is 1.7 μs, the expansion period is 1.7 μs (1 AL), the release period is 2.2 μs (1.3 AL), the contraction period is 0.7 μs (0.4 AL), and the rest period is 0 μs.

As shown by the graph 402, since there is no rest period, the pressure vibration generated by a discharge pulse for the first droplet is not amplified by the expansion pulse of the discharge pulse for the second droplet. As a result, the discharge rate of the second droplet does not increase to a value higher than the discharge rate of the first droplet.

Figure 16:
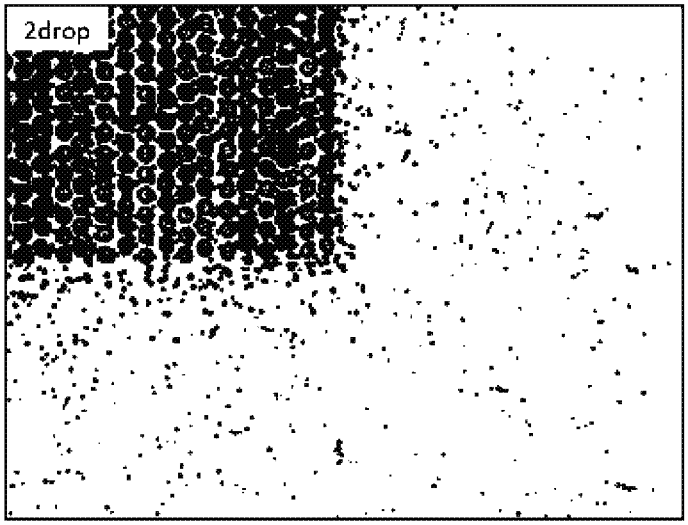
FIG. 16 illustrates an example of an image formed based on the discharge pulses of the related art.

Next, an image formed by the ink jet head 100 using the discharge pulses of the related art will be described. FIG. 16 illustrates an example of an image formed by the ink jet head 100 using the discharge pulses of the related art. FIG. 16 illustrates an example of an image formed by the discharge pulse of FIG. 15. Further, the ink jet head 100 forms an image 501.

As illustrated in FIG. 16, a large number of satellites are formed on the paper other than the region where the image 501 is formed. Compared to the example of FIG. 14, more satellites are formed.

The head drive circuit 101 may apply a two-step pulse in the expansion period. For example, the head drive circuit 101 may increase the voltage stepwise and decrease the voltage stepwise during the expansion period.

In addition, the head drive circuit 101 may apply a two-step pulse during the contraction period. For example, the head drive circuit 101 may decrease the voltage stepwise and increase the voltage stepwise during the contraction period.

The ink jet head configured as described above according to the embodiment provides a rest period between the discharge pulse for the first droplet and the discharge pulse for the second droplet. As a result, the ink jet head can reduce of mist or satellites.

In addition, in the ink jet head, the rest period is set to 0.3 AL or more. As a result, the ink jet head can increase the discharge rate of the second droplet to a value higher than the discharge rate of the first droplet. Therefore, the ink jet head can cause the second droplet of ink to merge with the first droplet of ink and form one larger ink droplet. As a result, the ink jet head can reduce mist or satellites.

In addition, in the ink jet head, the rest period is set to 1 AL or less. As a result, the ink jet head can promote the pressure vibration generated by the discharge pulse for the first droplet using the discharge pulse for the second droplet.

In addition, in the ink jet head, the distance between the midpoint of the expansion period and the midpoint of the contraction period is set to 2 AL or more. That is, the ink jet head makes the period of the discharge pulse and the natural vibration period different. As a result, the ink jet head can continue the pressure vibration even after the discharge pulse is applied.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid discharge head comprising:

an actuator configured to expand and contract a pressure chamber corresponding thereto; and a drive circuit configured to, during a dot formation cycle to form one dot:

apply a first discharge pulse to the actuator to cause a first droplet to be discharged from the pressure chamber; and after a predetermined rest period, during which no discharge pulse is applied to the actuator, has elapsed from application of the first discharge pulse, apply a second discharge pulse to the actuator to cause a second droplet to be discharged from the pressure chamber, a waveform of the first discharge pulse being the same as a waveform of the second discharge pulse, wherein a time period during which the first discharge pulse is applied includes an expansion period during which an expansion pulse to cause expansion of the pressure chamber from a neutral state is applied, a release period during which no pulse is applied to the pressure chamber to cause the pressure chamber to return to the neutral state, and a contraction period during which a contraction pulse to cause contraction of the pressure chamber from the neutral state is applied, in this order, and a time period from a midpoint of the expansion period to a midpoint of the contraction period is longer than a natural vibration period of the pressure chamber.

2. The liquid discharge head according to claim 1, wherein the time period from the midpoint of the expansion period to the midpoint of the contraction period is longer than two times of the natural vibration period of the pressure chamber.

3. The liquid discharge head according to claim 1, wherein the predetermined rest period is longer than the contraction period.

4. The liquid discharge head according to claim 1, wherein the predetermined rest period is shorter than the expansion period.

5. The liquid discharge head according to claim 1, wherein the predetermined rest period is set to a value equal to or greater than 0.15 times of a natural vibration period of the pressure chamber and equal to or less than 0.5 times of the natural vibration period.

6. The liquid discharge head according to claim 1, wherein the predetermined rest period is set to a value such that the second discharge pulse starts to be applied to the actuator while a pressure vibration of the pressure chamber caused by application of the first discharge pulse to the actuator is continuing and attenuating.

7. The liquid discharge head according to claim 1, wherein the predetermined rest period is set to a value such that a discharge speed of the second droplet is greater than a discharge speed of the first droplet.

8. The liquid discharge head according to claim 7, wherein the predetermined rest period is set to a value such that the second droplet merges with the first droplet while dropping.

9. A printer comprising:

a medium conveyer; and a liquid discharge head configured to discharge droplets of liquid to a medium conveyed by the medium conveyer, the liquid discharge head including an actuator configured to expand and contract a pressure chamber corresponding thereto; and a drive circuit configured to, during a dot formation cycle to form one dot:

apply a first discharge pulse to the actuator to cause a first droplet to be discharged from the pressure chamber; and after a predetermined rest period, during which no discharge pulse is applied to the actuator, has elapsed from application of the first discharge pulse, apply a second discharge pulse to the actuator to cause a second droplet to be discharged from the pressure chamber, a waveform of the first discharge pulse being the same as a waveform of the second discharge pulse, wherein a time period during which the first discharge pulse is applied includes an expansion period during which an expansion pulse to cause expansion of the pressure chamber from a neutral state is applied, a release period during which no pulse is applied to the pressure chamber to cause the pressure chamber to return to the neutral state, and a contraction period during which a contraction pulse to cause contraction of the pressure chamber from the neutral state is applied, in this order, and a time period from a midpoint of the expansion period to a midpoint of the contraction period is longer than a natural vibration period of the pressure chamber.

10. The printer according to claim 9, wherein the time period from the midpoint of the expansion period to the midpoint of the contraction period is longer than two times of the natural vibration period of the pressure chamber.

11. The printer according to claim 9, wherein the predetermined rest period is longer than the contraction period.

12. The printer according to claim 9, wherein the predetermined rest period is shorter than the expansion period.

13. The printer according to claim 9, wherein the predetermined rest period is set to a value equal to or greater than 0.15 times of a natural vibration period of the pressure chamber and equal to or less than 0.5 times of the natural vibration period.

14. The printer according to claim 9, wherein the predetermined rest period is set to a value such that the second discharge pulse starts to be applied to the actuator while a pressure vibration of the pressure chamber caused by application of the first discharge pulse to the actuator is continuing and attenuating.

15. The printer according to claim 9, wherein the predetermined rest period is set to a value such that a discharge speed of the second droplet is greater than a discharge speed of the first droplet.

16. The printer according to claim 15, wherein the predetermined rest period is set to a value such that the second droplet merges with the first droplet while dropping.

* * * * *